US006147585A

United States Patent [19]

Kalra et al.

[11] Patent Number: 6,147,585

[45] Date of Patent: Nov. 14, 2000

[54] SUBMINIATURE FUSE AND METHOD FOR MAKING A SUBMINIATURE FUSE

[75] Inventors: Varinder K. Kalra, Chesterfield; Keith A. Spalding, Fenton, both of Mo.

[73] Assignee: Cooper Technologies Company, Houston, Tex.

[21] Appl. No.: 09/336,735

[22] Filed: Jun. 21, 1999

Related U.S. Application Data

[63] Continuation-in-part of application No. 09/135,589, Aug. 18, 1998, abandoned, which is a continuation of application No. 08/792,177, Jan. 29, 1997, Pat. No. 5,812,046.

[51] Int. Cl.[7] ..... H01H 69/02; H01H 85/143; H01H 85/157

[52] U.S. Cl. ..... 337/248; 337/232; 337/227; 337/186; 337/228; 29/623

[58] Field of Search ..... 337/414, 290, 337/231, 232, 237, 248, 251, 252, 253, 254, 227, 228, 166, 186, 245, 246, 255, 273, 158, 279, 260, 297, 234; 29/619, 623, 844, 855, 175; 257/529

[56] References Cited

U.S. PATENT DOCUMENTS

| | | | |
|---|---|---|---|
| 1,121,876 | 12/1914 | Schipper | 337/234 |
| 1,502,881 | 7/1924 | Sandin | 337/250 |
| 2,168,153 | 8/1939 | Brown | 337/234 |
| 2,929,900 | 3/1960 | White | 337/246 |
| 3,275,772 | 9/1966 | Neff | 337/247 |
| 3,333,336 | 8/1967 | Cameron et al. | 29/623 |
| 3,374,330 | 3/1968 | Cameron | 337/231 |
| 3,460,086 | 8/1969 | Fister | 337/202 |
| 3,962,668 | 6/1976 | Knapp, Jr. | 337/228 |
| 4,035,753 | 7/1977 | Reeder | 337/186 |
| 4,158,187 | 6/1979 | Perreault | 337/248 |
| 4,189,696 | 2/1980 | Beswick et al. | 337/232 |
| 4,346,362 | 8/1982 | Feenan et al. | 337/248 |
| 4,460,887 | 7/1984 | McAlear et al. | 337/186 |
| 4,532,489 | 7/1985 | Phillips | 337/228 |
| 4,540,969 | 9/1985 | Sugar | 337/232 |
| 4,646,053 | 2/1987 | Mosesian | 337/232 |
| 4,680,567 | 7/1987 | Edwards | 337/164 |
| 4,684,915 | 8/1987 | Knapp, Jr. | 337/276 |
| 4,746,784 | 5/1988 | Vermij | 219/121 LD |
| 4,918,420 | 4/1990 | Sexton | 337/205 |
| 4,965,925 | 10/1990 | Monter | 29/623 |
| 4,972,169 | 11/1990 | Kalra | 337/163 |
| 4,996,509 | 2/1991 | Bernstein | 337/232 |
| 5,214,406 | 5/1993 | Reese et al. | 337/231 |
| 5,235,307 | 8/1993 | Oh | 337/228 |
| 5,739,740 | 4/1998 | Stark et al. | 337/248 |
| 5,812,046 | 9/1998 | Brown et al. | 337/290 |
| 5,994,994 | 11/1999 | Ito et al. | 337/248 |

FOREIGN PATENT DOCUMENTS

| | | | |
|---|---|---|---|
| 8-64106 | 3/1996 | Japan | H01H 85/143 |
| 10-177835 | 6/1998 | Japan | H01H 85/147 |
| 10-308159 | 11/1998 | Japan | H01H 85/147 |
| 7-211221 | 11/1998 | Japan | H01H 85/175 |

*Primary Examiner*—Leo P. Picard
*Assistant Examiner*—Anatoly Vortman
*Attorney, Agent, or Firm*—Armstrong Teasdale LLP

[57] ABSTRACT

A method for manufacturing a subminiature fuse includes the steps of applying metallized coatings to surfaces at axially opposite ends of a hollow fuse body, placing a fuse element in an internal cavity in the fuse body, the fuse element extending from the first end to the second end of the cavity, placing a one of a solder and brazing preform and end termination at each of the first and second ends of the cavity, and heating the assembled fuse body, fuse element, solder preforms and end terminations to a temperature sufficient to cause the solder preforms to bond the fuse element to the end terminations and for the end terminations to bond with the metallized end portions of the fuse body, wherein the end terminations close the ends of the cavity. A subminiature fuse according to the invention includes a fuse body with a fuse element disposed in the body. The fuse body includes metallized end portions to which the end terminations are bonded. One of a solder and brazing preform bond the fuse element to the end terminations.

8 Claims, 5 Drawing Sheets

SUBMINIATURE FUSE AND METHOD FOR MAKING A SUBMINIATURE FUSE

CROSS-REFERENCE TO RELATED APPLICATIONS

This application is a continuation-in-part of U.S. Application No. 09/135,589, filed Aug. 18, 1998, now abandoned, which is a continuation of U.S. Application No. 08/792,177, filed Jan. 30, 1997, now issued U.S. Pat. No. 5,812,046.

BACKGROUND AND SUMMARY

The present invention is directed to a fuse and a method for making a fuse. More particularly, the invention relates to a subminiature fuse having a tubular body and a fuse element disposed within the interior of the body.

Manufacturing subminiature fuses is labor and time intensive in handling and assembling the parts and in connecting the fuse element to the end terminations. This is of particular concern in manufacturing subminiature time lag fuses, in which a fuse element is disposed between the end terminations in air or gas.

It is a well known fact that for a fuse to perform consistently on low overloads, the current carrying element has to be kept away from touching the inside walls of the fuse body. Typically, funnels are used to guide and maintain the fuse element away from the inside walls of the fuse body during first end soldering. After first end solder, the funnels are removed for reuse. In a separate step, second end solder joints are made to complete the fuse assembly.

In another variation, end caps with holes are glued at each end of the fuse body and fuse wire is then passed through holes for solder connection at the outer surface of the end caps.

In some constructions, a fuse wire element is placed and attached to a supporting bridge of fiber, glass melamine, ceramic etc. This bridge will either have a metallic foil mechanically attached at each end or a metallized portion to establish a solder joint between the fuse element and the end cap.

All these techniques require many steps in assembly, are slow and therefore very expensive.

The present invention describes a method of metallizing a fuse body so that a meniscus is formed on the inside of the fuse body at each end. This meniscus keeps the element away from contacting the inside wall of the fuse body and thus helps to achieve a consistent performance on low overloads.

Also, the assembly cost is much lower since the process is capable of simultaneous soldering of termination at each end.

The present invention provides a method for manufacturing subminiature fuses that is a low-cost, batch process method. The method is suitable for manufacturing a variety of subminiature fuses, including time-lag fuses, surface mount fuses, leaded fuses, and other types, as will be understood through the following description.

The present invention also provides a subminiature fuse that is capable of withstanding the stresses of circuit board assembly, soldering, and cleaning without degradation of the fuse or its operability. The present invention provides a subminiature fuse with a sealed cavity to contain the fusible element.

According to the invention, an elongated, hollow fuse body, having an internal cavity for containing a fuse element, is coated at end portions with a metallic material to form a metallic coating. Upon assembly of a fuse element, solder preforms, and end terminations with the fuse body, the unit is heated and the metallic coating, the end terminations and fuse element are bonded together forming a seal to close the cavity of the fuse body.

According to one embodiment of the invention, the metallic coating may include a thickened region internally on the fuse body to form a guide for the fuse element and to facilitate attachment of the fuse element to the remainder of the fuse.

According to the invention, the end terminations may comprise end plates formed of electrical conductive material, which are attached to end faces of the fuse body. The end plates are soldered or brazed to the end faces of the body on the metallized coating, which facilitates forming a secure bond. The end plates may be square, rectangular, or circular (i.e., disk shaped). Disk-shaped end plates eliminate the need to orient the end plate to the side edges of the fuse body. The end terminations may alternatively comprise caps which are placed over the metallized end portions of the fuse body. The solder or brazing alloy preforms on the end portions of the fuse body will melt and bond with the end caps or the disk-shaped elements to form the seal of the interior cavity. The end plates or caps may be provided with axially-extending leads, if desired.

A method according to the invention includes the steps of applying metallized coatings to axially opposite surface end portions of a hollow fuse body and placing a fuse element in the internal cavity in the fuse body so that the fuse element extends from the first end to the second end of the cavity. A solder or brazing alloy preform is placed at each of the first and second ends of the cavity and an end termination is placed at each of the first and second ends in contact with the preform. The assembly thus formed is heated to a temperature sufficient to cause the solder preforms to soften and flow for bonding the fuse element to the end terminations. The end terminations then form seals closing the ends of the cavity.

According to another aspect of the invention, the method includes the steps, prior to the heating step, of placing the assembled fuse body, fuse element, solder or brazing preforms and end terminations in an environmentally controlled chamber, and charging the chamber with a selected gas so that the cavity is filled with the selected gas before being sealed.

According to the invention, the selected gas may be at a pressure greater than atmospheric pressure, or alternately at a pressure less than atmospheric pressure.

The selected gas may be an inert gas, such as nitrogen. Alternatively, the gas may be sulfur hexafluoride, which is believed to provide arc suppression, to improve the interrupting ability of the fuse.

According to another aspect of the invention, the fuse body is placed in a vertically-oriented recess in a fixture. The fuse element is then placed in the cavity in the fuse body. The fuse components are heated for bonding in this fixture, which eliminates special handling of the fuse element to achieve a gas or air insulation around the fuse element. According to another aspect of the invention, the fixture may be vibrated in stages to cause the fuse bodies to enter the recesses in the fixture.

The fuse element includes a substantially rigid structure so that it maintains its orientation in the cavity and avoids contact with the inside surface of the fuse body. The fuse element may comprise a wire element wound on an electrically insulating core. Alternatively,the fuse element may comprise an electrically conductive film element carried on an electrically insulating substrate. Other fuse element structures may also be suitable, for example, a metallic link or a wire.

BRIEF DESCRIPTION OF THE DRAWINGS

The invention will be better understood through the following description in conjunction with the appended drawings, which are not drawn to scale and are simplified for the purposes of the description. In the drawings.

DETAILED DESCRIPTION OF THE PREFERRED EMBODIMENTS

Figure 1:
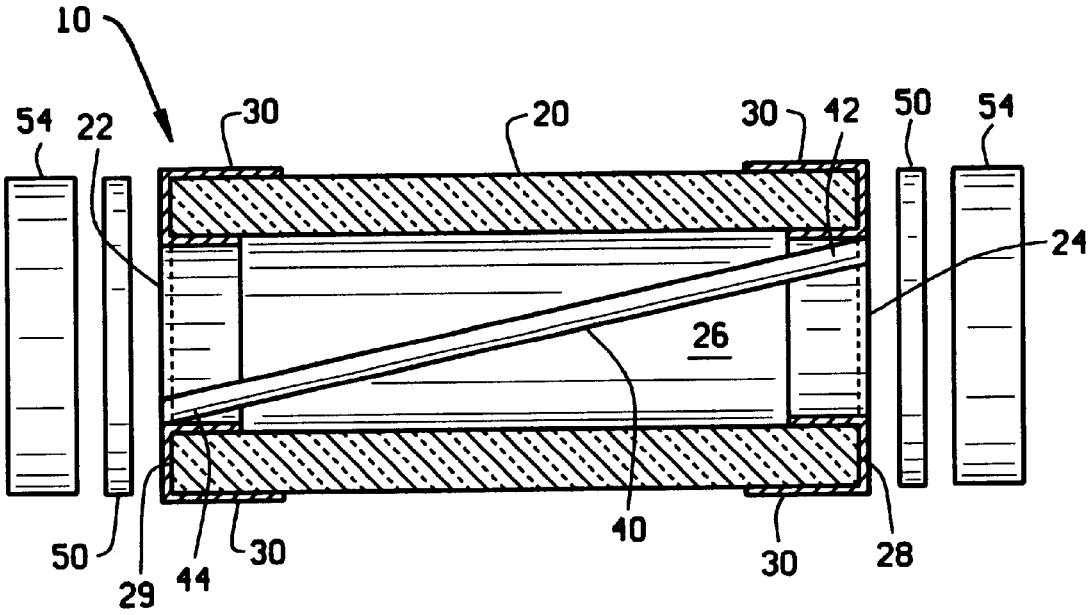
FIG. 1 is an exploded view of a subminiature fuse in accordance with the invention.

As shown in FIG. 1 in an exploded view, a subminiature fuse 10 in accordance with the invention includes an elongated, hollow body 20 having opposite open first and second ends 22, 24. The body 20 is a tubular element, preferably shaped with a square or rectangular profile, as seen in the end view of FIG. 2, and has a central cavity 26 extending from a first end 22 to a second end 24. A rectangular profile facilitates handling of the fuse for mounting on a circuit board, for example.

The body 20 is formed of an electrically insulating material, preferably capable of withstanding high temperature, solder and brazing processing. Suitable materials include glass, a glass and mica blend, quartz, alumina, forsterite, alumina-zirconia, zirconia, Mykroy®, Mycalex®, Nextel, or a type of $MgO—Al_2O_3—SiO_2$ ternary system.

Portions of the fuse body 20 at the opposite ends 22, 24 are provided with a coating 30 of metal or metallized material that is capable of conducting electricity. The coating 30 is applied to the end portions by any convenient method, including deposition or dipping in molten material, for example, a thick film paste. The coating 30 is applied to at least the end faces 28, 29 of the fuse body 20, and preferably is applied also to the outside lateral surface. More preferably, the inside surface is also coated with the metallization coating, as is shown in FIG. 1. As will be explained in greater detail below, the metallization coating 30 helps to seal the end openings 22, 24 of the fuse body 20 to end terminations, and also facilitates forming the electrical connection between the fuse element and the end terminations. The metallization coating also facilitates forming electrical connection and mechanical attachment to a circuit board.

A fuse element 40 is disposed in the cavity 26 of the fuse body 20 and extends from the first end 22 to the second end 24. As shown in FIG. 1, the fuse element 40 is disposed diagonally across the cavity 26 so that only the opposite ends 42, 44 of the fuse element are in contact with the fuse body 20. This arrangement is preferred for fuse construction to provide air or gas insulation surrounding the fuse element 40. Also, as shown, the fuse element 40 does not extend outside of the cavity 26 and is contained entirely within the fuse body 20, which facilitates manufacturing the fuse in accordance with the method of the present invention, as further described below.

The fuse element 40 includes an electrically conductive fusible portion that is selected to fuse, that is, interrupt electric current, under selected conditions. The fuse element 40 may be a spiral-wound wire on a suitable electrically insulating core material, for example, silicon, fiberglass, and ceramic. The fuse element can also be a spiralwound wound wire on an electrically conductive core of higher resistance. Alternatively, the fuse element 40 may be a conductive film deposited on an elongated substrate. The core or substrate can be provided with conductive terminations at the ends 42, 44 to improve connecting the fuse element 40 to end terminations in the fuse 10. A straight wire or metal link element may alternatively be used for certain interrupting conditions.

The fuse element may be any suitable material known to those of skill in the art. Some examples include tin plated copper based wire and copper wire with silver plating.

Figure 2:
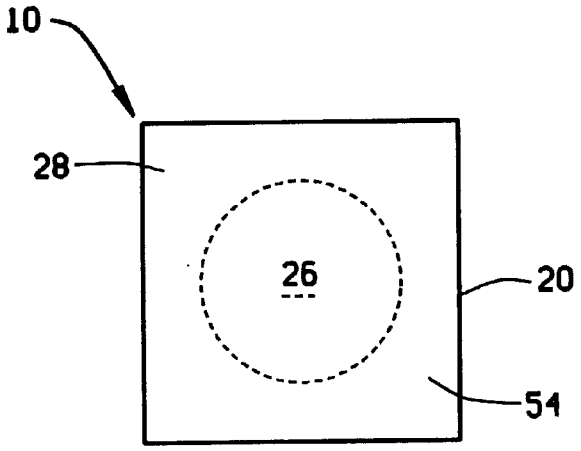
FIG. 2 is an end view of the subminiature fuse of FIG. 1.
Figure 3:
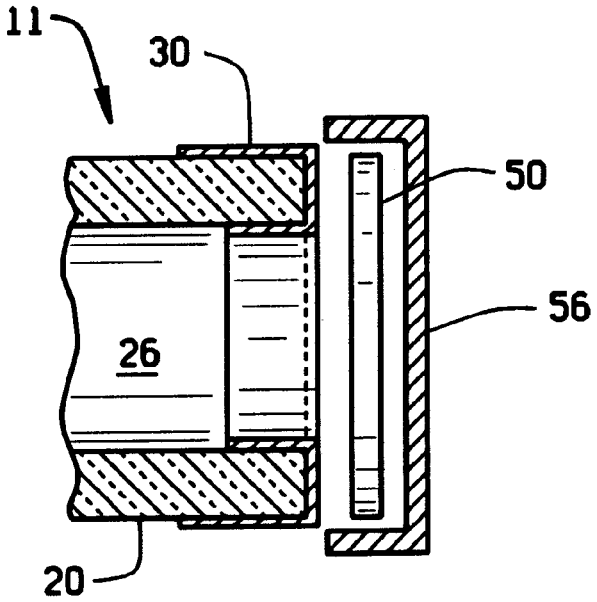
FIG. 3 is a partial view of an alternative embodiment of the subminiature fuse of FIG. 1.
Figure 4:
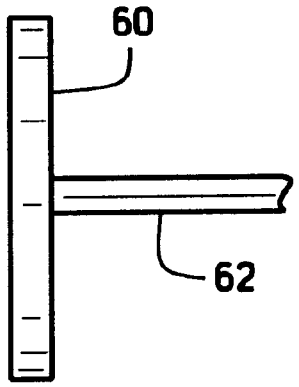
FIG. 4 is a side view of an end termination with a lead, which may be used alternatively in the fuse of FIG. 1.

At the first 22 and second 24 ends, solder or brazing preforms 50 are connected to the fuse body 20. End terminations are provided for connecting the fuse 10 in an electrical circuit. Shown in FIG. 1, the end terminations are end plates 54 attached to the solder or brazing preforms 50 and fuse body 20. As seen in FIG. 2, the end plates 54 are square-shaped plates. FIG. 3 and FIG. 4 illustrate alternative end terminations that can be used for a fuse according to the invention. In FIG. 3, which is an exploded, partial view of an end of a fuse 11, the end termination is a cap 56, which is placed over an end portion of the fuse body 20 in contact with the solder preform 50 and the metallization coating 30 on the outer surface of the fuse body 20. FIG. 4 illustrates in side view an end plate 60 having a lead 62. The leaded end plate 60 is disposed on the fuse body 20 in the same manner as the end plate 54 of FIG. 1, that is, in abutting relationship with the solder or brazing preform and end surface of the fuse body. The cap 56 of FIG. 3 may alternatively be formed to include a lead similar to that shown in FIG. 4.

The solder or brazing preforms 50 are attached directly to the end faces of the fuse body 20 and to the ends of the fuse element 40 by heating to the softening point the preform material, which allows it to flow and bond the end terminations to the fuse element 40. The preform 50 also bonds with the end plates to the metallized ends of the fuse body 20.

In the embodiment of FIG. 3, the end termination cap 56 is further bonded to the fuse body 20 by the metallization coating 30 on the outer lateral surfaces of the fuse body 20.

The metallized coating 30 facilitates bonding of the preforms 50 and end terminations with the fuse body 20 and the formation of a seal to close the open ends 22, 24 of the fuse body. The cavity 26 may thus be sealed to provide a closed environment for a fuse element. The sealed cavity 26 may accordingly be provided with a selected environment, a selected gas at a selected pressure. A gas with arc-quenching properties may be selected to improve the current interrupting capability of the fuse, and may be for example, sulfur hexafluoride. The gas environment may be selected for insulation value for time-lag fuse construction. An inert gas, nitrogen or another, may be selected. However, it is not necessary for the fuse to be hermetically sealed.

Figure 5:
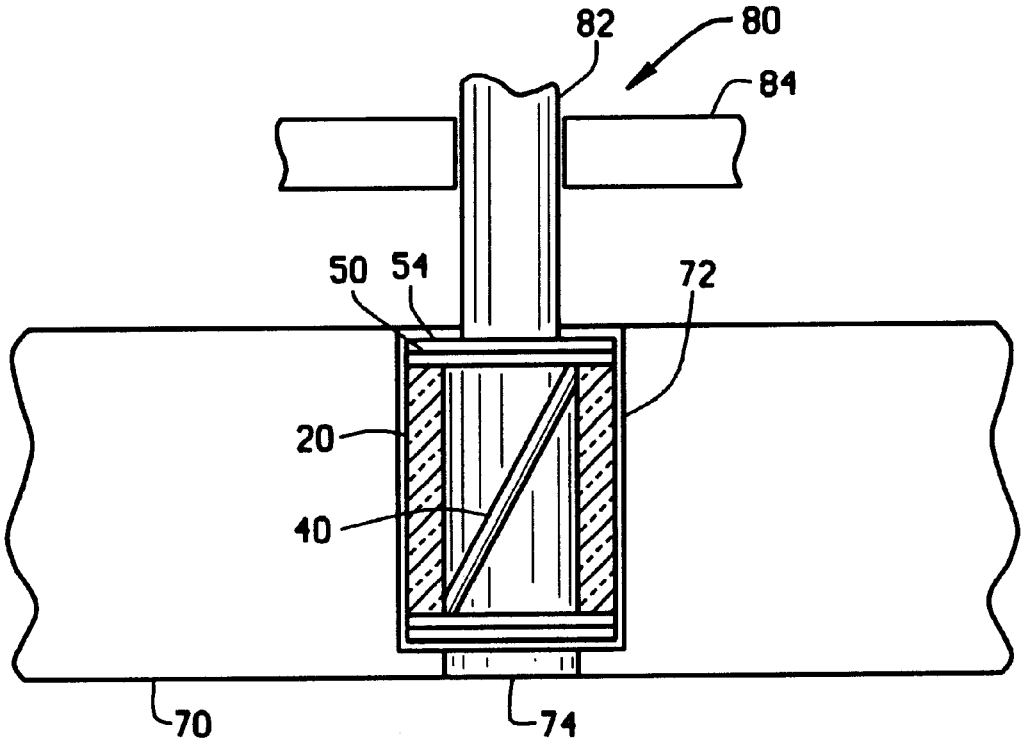
FIG. 5 is a schematic view of a fixture for manufacturing the subminiature fuse according to the method of the invention.
Figure 6:
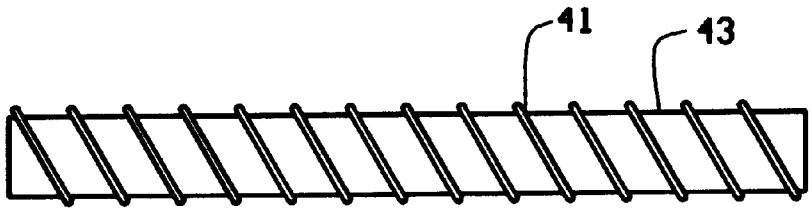
FIG. 6 illustrates a wire fuse element wound on a substrate.
Figure 7:
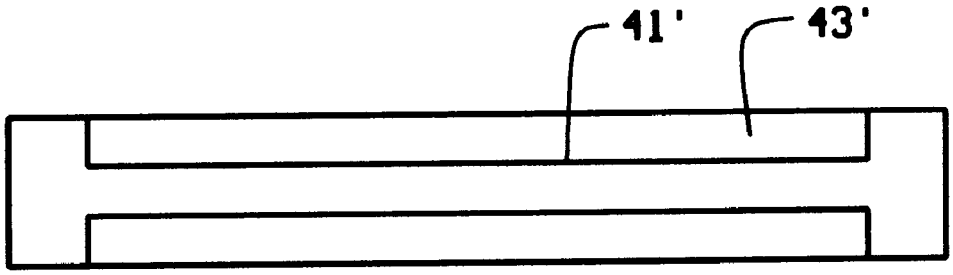
FIG. 7 illustrates a printed film fuse element carried on a substrate.

A method of manufacturing a subminiature fuse may be understood in connection with FIG. 5, which shows schematically a part of an apparatus used in the method. The apparatus includes a fixture 70 for holding the assembly elements of the fuse for the heating step. The fixture includes a plate 70 having a multiplicity of recesses 72, each sized for holding a fuse body 20, solder preforms 50 and end terminations 54 in a selected orientation. The recesses 72 may include a hole 74 at the bottom end to accommodate a lead, if a leaded end termination such as shown in FIG. 4 is used. An apparatus of this type is available from Scientific Sealing Technology of Downey, Calif., as the DAP-2200 Furnace.

The method includes the step of applying the metallized coatings 30 to axially opposite surface end portions of the fuse body. As mentioned, any suitable means may be used to apply the coating 30 to the fuse body, including, but not limited to, deposition and dipping in thick film paste. The metallized coating can be fixed to the fuse body by firing. The coating 30 may be applied by using Palomar dipping equipment. The metallized coating is a low temperature silver ink supplied by Ferro Corp. The part number for the silver ink is T2083.

The fuse body is placed in the recess in the fixture, which holds it in vertical orientation. A fuse element is then placed in the cavity of the fuse body, the fuse element having a length sufficient to extend from the first end to the second end of the cavity. The vertical orientation of the fuse body and fuse element in the fixture allows the fuse element to assume the position shown, i.e., away from the inside wall of the fuse body, and greatly simplifies manufacturing by eliminating special handling conventionally required to position the fuse element in this manner.

A solder or brazing preform is placed at each of the first and second ends of the cavity and an end termination is placed at each of the first and second ends in contact with the preform. The assembly thus formed is heated to a temperature sufficient to cause the preforms to soften and flow for bonding the fuse element to the end terminations. The end terminations may then form seals closing the ends of the cavity.

The heating step is preferably performed directly by use of the fixture plate 70, which is formed from graphite and includes electrical connections. Electric current is passed through the plate 70, which is heated by resistance. Heat in the plate 70 is then transferred to the recesses, and thus directly to the assembled components of the fuse.

According to a preferred aspect of the invention, the fixture plate has a multiplicity of holes, and the fuse bodies are placed in the holes by placing a multiplicity of fuse bodies on the upper surface of the fixture plate and vibrating or shaking the plate to cause the fuse bodies to each fall into a recess. The recesses are slightly larger than the width of the fuse bodies to facilitate entry of the fuse bodies in a recess. After the fuse bodies are installed in the recesses, a multiplicity of fuse elements is placed on the upper surface of the fixture plate 70, and the plate is again vibrated or shaken to cause the fuse elements each to fall into a recess and into the cavity in the fuse body.

The vibration step is also advantageous for assembling rectangular profile fuse bodies 20 with end caps 56 which must be oriented correctly so that the cap is placed over the end portion of the fuse body. The caps 56 are placed in recesses 72, and the vibration of the fixture plate 70 also succeeds in causing the fuse bodies to align with and insert in the caps.

According to another aspect of the invention, the method includes the steps, prior to the heating step, of placing the assembled fuse body, fuse element, solder or brazing preforms and end terminations in an environmentally controlled chamber. The chamber may then be evacuated and then charged with a selected gas so that the cavity is filled with the selected gas before being sealed. The selected gas may be chosen for arc quenching property, for example, sulfur hexafluoride. Alternatively, a gas having insulating properties may be chosen, particularly for a time-lag fuse construction. The selected gas may be an inert gas, such as nitrogen. The selected gas may be provided at a pressure greater than atmospheric or less than atmospheric pressure. Alternatively, the selected gas may be air.

A weighting device 80 may be used to apply pressure to the assembly of the fuse body 20, solder preforms 50 and end terminations 54 while the heating step is performed to ensure that the components effectively and securely bond. The weighting device 80 includes a supporting frame 84 and a multiplicity of weight rods 82 slidably supported in the frame. The weighting device 80 provides one weight rod 82 for each of the recesses 72. The frame 84 is mounted on legs (not shown) in position above the upper surface of the fixture plate so that the weight rods 82 align with the recesses in the fixture plate 70. The frame 84 and fixture plate 70 may be provided with alignment holes and mounting in mutual alignment through the use of posts engaging the alignment holes.

Figure 8:
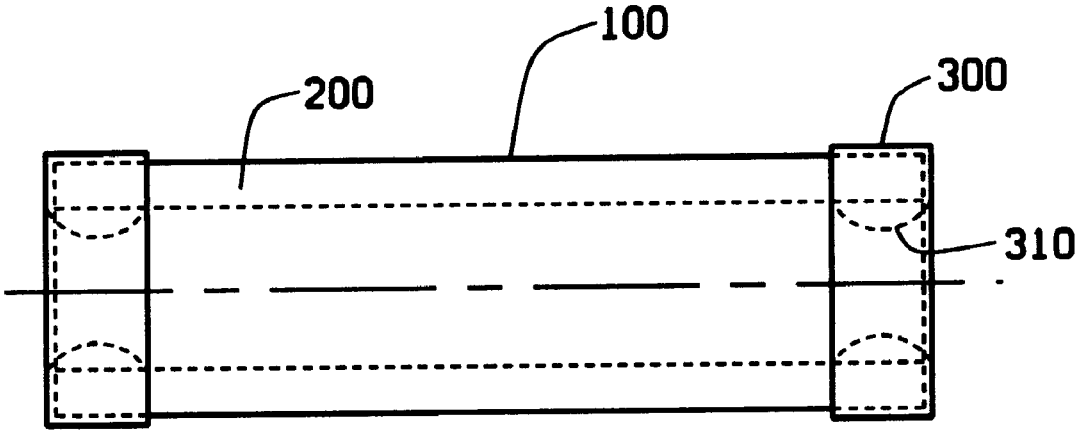
FIG. 8 is a side view of a fuse body according to an alternative embodiment of the invention.
Figure 9:
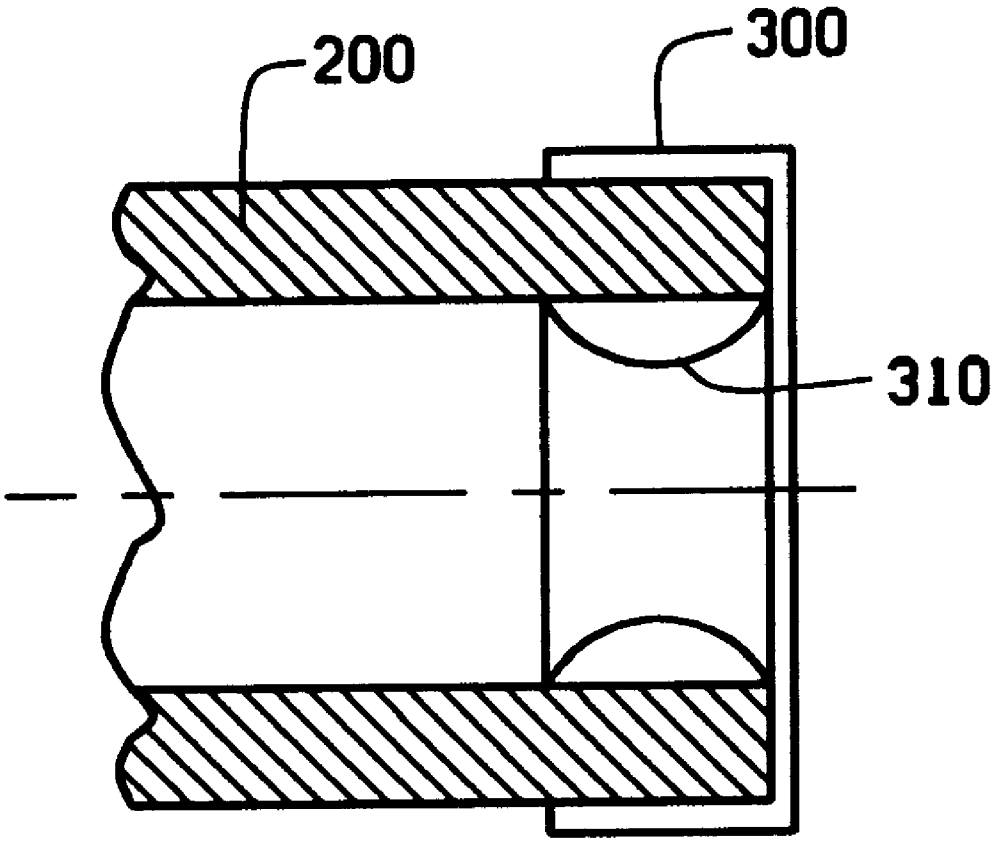
FIG. 9 is a cross-section of one end of the fuse body illustrated in FIG. 8.

Another embodiment of the present invention is illustrated with respect to FIGS. 8 and 9. Except as otherwise set forth herein, the second embodiment is substantially the same as the first embodiment described hereinabove. Accordingly, the foregoing sections of this disclosure apply equally to the embodiment illustrated in FIGS. 8 and 9, except as distinguished below.

A primary difference between the first and second embodiments is that the second embodiment has a built-up meniscus 310 of metallization on an interior portion of the fuse body 200. The meniscus 310 may be created by dipping the end of the fuse body into the low temperature silver ink twice. After dipping the fuse body 200 two times into the low temperature silver ink, the opening of the fuse body 200 may be too constricted by the ink buildup. Accordingly, an air knife jet or pin is used to open the end of the fuse body if the ink build-up was too great. In a preferred embodiment, the diameter of the opening between the inner portions of the meniscus 310 is approximately 0.050 inches (1.27 millimeters). Thus, the minimum inside diameter of the ink meniscus 310 is preferably 0.050 inches. The thickness of the ink meniscus is preferably a minimum of approximately 0.0025 inches (0.064 millimeters). The meniscus is substantially semi-circular in cross-section.

Although one preferred method dips the fuse body twice into the ink, alternative inks or solutions may be used that will create the desired meniscus with only one dipping or with three or more dippings.

In preparing the low temperature silver ink for dipping, it is preferable to ensure that the viscosity of the ink is at a desired level. In a preferred embodiment, the viscosity, as read with a Brookfield viscometer, should be within the range of about 60 to 65. If the viscosity is above 65, the viscosity may be lowered by adding a viscosity modifier such as Terpineol. If the viscosity is below 60, the viscosity may be increased by adding additional fresh ink. The ink may be any suitable low temperature silver ink. In a preferred embodiment, the ink is supplied by Ferro Corporation, part number T2083.

It may be advantageous to place the ink on mixing rollers for at least one hour to remove any air trapped in the ink. Mixing the ink on the rollers will help the ink modifier dispense uniformly into the mixture and may cause the ink viscosity to shift from a previous reading. Thus, if the ink is placed on rollers to remove trapped air, the viscosity should be checked again after mixing.

After the tube 200 has been dipped in the silver ink, and an air knife jet or pin has been used to open the ink diameter to the desired level, the fuse of the second embodiment is then assembled as set forth above with regard to the first embodiment. Thus, the assembly information set forth above is incorporated herein by reference.

The invention has been described and illustrated in terms of preferred embodiments and principles, however, it should be recognized that variation and changes may be made without departing from the invention as defined in the following claims.

We claim:

1. A subminiature fuse, comprising:

a fuse body formed of electrically insulating material and having an internal cavity extending from a first end to a second end, the first and second ends each having an opening communicating with the cavity;

a metallized coating applied to portions of the fuse body at both the first end and second end, the metallized coating covering at least outer end faces and an inside end portions of the fuse body, said metallized coating including a built-up portion on the inside end portions of the fuse body to create a convex shaped meniscus on the inside end portions of the fuse body;

a fuse element disposed in the cavity and extending from the first end to the second end;

end terminations at both the first end and the second end, the end terminations bonded to the fuse body on the metallized coating, wherein the terminations close the cavity; and electrical conductive material disposed between the end terminations and terminal portions of the fuse element at both the first end and the second end of the cavity, the material forming an electrically conductive joint connecting the end terminations to the fuse element.

2. A subminiature fuse as claimed in claim 1, wherein the meniscus is substantially semi-circular in cross-section.

3. A subminiature fuse as claimed in claim 1, wherein the fuse body is a tubular shaped body having a rectangular profiled exterior, and the end terminations comprise a square-shaped end plate bonded to end surfaces of the fuse body.

4. A subminiature fuse as claimed in claim 1, wherein the end terminations comprise end caps, each disposed over a portion of the fuse body at the first end and the second end.

5. A subminiature fuse as claimed in claim 1, wherein each end termination includes a lead extending therefrom for connecting the fuse in an electrical circuit.

6. A subminiature fuse as claimed in claim 1, wherein the fuse element includes a fusible link carried on a substantially rigid substrate and extends across the cavity to avoid contacting an interior of the fuse body between the first and second ends.

7. A subminiature fuse as claimed in claim 1, wherein the fuse element comprises a fusible wire element on an electrically insulating core.

8. A subminiature fuse as claimed in claim 1, wherein the fuse element comprises a conductive film deposited on a substrate of insulating material.

* * * * *